United States Patent [19]

Goglio

[11] Patent Number: 5,024,538

[45] Date of Patent: Jun. 18, 1991

[54] PACKAGING BAG, ESPECIALLY FOR COOKED HAM, PROVIDED WITH DRAIN VALVE

[76] Inventor: Luigi Goglio, Via Solari 10, Milan, Italy

[21] Appl. No.: 318,077

[22] Filed: Mar. 2, 1989

[30] Foreign Application Priority Data

Mar. 10, 1988 [IT] Italy ..... 20831/88[U]

[51] Int. Cl.[5] ..... B65D 33/01

[52] U.S. Cl. ..... 383/103; 229/87.11; 383/58; 426/113; 426/129; 426/412

[58] Field of Search ..... 383/103, 100, 67, 45, 383/58; 426/113, 118, 129, 412; 229/87 F; 99/403, 407, 410

[56] References Cited

U.S. PATENT DOCUMENTS

| | | | |
|---|---|---|---|
| 436,287 | 9/1890 | Marshall | 383/103 |
| 1,924,903 | 8/1933 | Birdseye | 229/87 F |
| 2,071,300 | 2/1937 | Gammeter | 426/412 |
| 2,632,723 | 3/1953 | Bennett | 229/87 F |
| 2,802,743 | 8/1957 | Ellies | 426/129 |
| 2,849,322 | 8/1958 | Brucker | 426/129 |
| 2,876,112 | 3/1959 | Vail | 383/103 |
| 3,074,798 | 1/1963 | Palmer | 426/129 |
| 3,297,234 | 1/1967 | Honsel et al. | 383/45 |
| 3,730,076 | 5/1973 | Levin | 383/103 |

*Primary Examiner*—Stephen P. Garbe

[57] ABSTRACT

A packaging bag, in particular for cooked ham, made of thermoweldable material and provided, on at least one of its walls, with a drainage hole. The inside of the bag also includes a drainage valve secured at the wall of the bag. The drainage valve comprises a disc of a plastic material, and is provided with a plurality of radial, spaced ribs projecting from its surface. The ribs face the internal surface of the wall of the bag, and the wall is secured to the ribs by thermowelding. The center zone of the disc will match with the center zone of the drainage hole.

5 Claims, 1 Drawing Sheet

PACKAGING BAG, ESPECIALLY FOR COOKED HAM, PROVIDED WITH DRAIN VALVE

DESCRIPTION OF INVENTION

At present, the meat used for production of cooked ham is subjected to a cooking and shaping process in suitable metal molds, from which the meat chunk is removed after adequate cooling and introduced in a packaging before being passed on to the further processing phases.

According to a manufacturing process which is the subject matter of a patent application filed by the applicant, is adopted a packaging bag apt to allow the cooking of the meat to produce the cooked ham in the packaging bag itself.

For this purpose, the packaging bag must be suitable to allow drainage of the liquefied fat and other liquids. According to this patent, in order to permit the fat to escape, the invention contemplates the use of a heat weldable material packaging bag provided, on at least one of its walls, with a hole, at which is secured to the wall of the bag a drainage valve inside the bag itself. This valve consists of a disc equipped with suitably spaced projecting ribs apt to permit to secure the disc to the bag wall, for example, by thermo welding in such manner that the center of the disc matches with the center of the drainage hole. The invention will now be explained, in conjunction with the annexed drawings which illustrate by way of example and non limitedly a preferred embodiment of the disc acting as a drainage valve.

In the drawing

Figure 1:
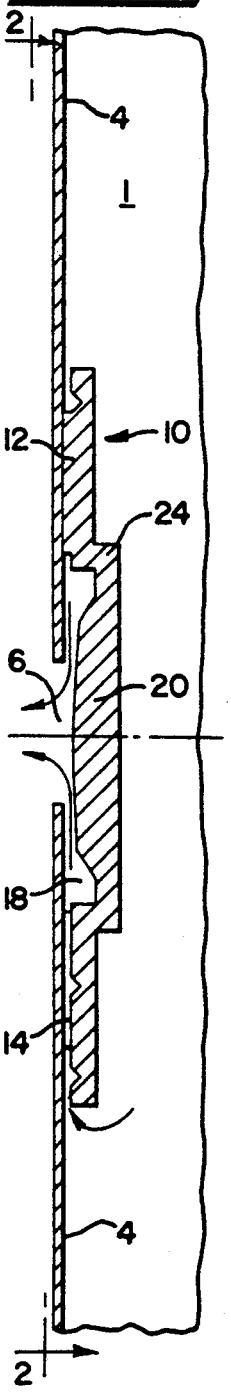
FIG. 1 is a view in cross section of a wall of the bag, to which the drainage valve according to the invention is applied.

According to FIG. 1, the bag identified by integer 1 comprises walls 4 made of heat weldable material, at least one of said walls being provided with a hole 6 apt to permit drainage of the liquified fat and other liquids developed during the cooking phase of the meat (not shown) contained in the bag itself.

Figure 3:
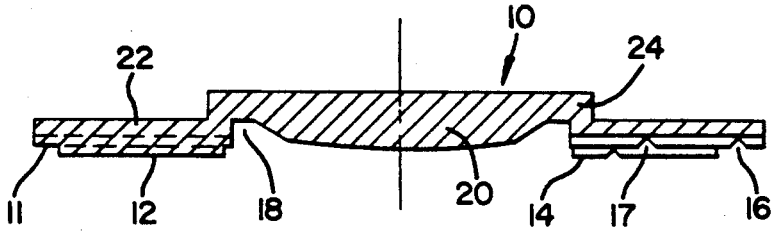
FIG. 3 is a cross section, taken on lines III—III of the drainage valve FIG. 2.
Figure 2:
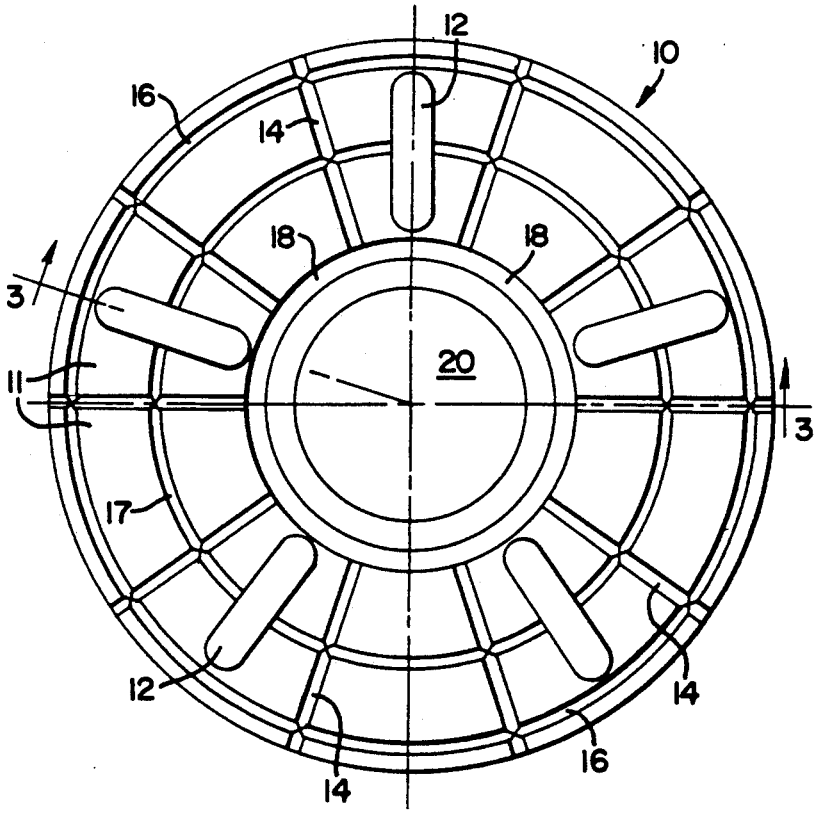
FIG. 2 is a view of the drainage valve taken on lines II—II of FIG. 1.

A drainage valve 10 is applied on the internal surface of wall 4 of the bag (FIGS. 2 and 3); said drainage valve consists of a disc made of plastic material, the surface 11 of which, facing the wall of the bag, is provided with a plurality of radial projecting ribs 12 as well as radial grooves 14 and circular grooves 16,17 which intersect said radial grooves.

Radial grooves 14 lead into an annular collecting recess 18 delimiting a central circular zone 20, preferably slightly convex, the apex of which is located substantially at the same level of surface 11 of the disc. Said disc is provided, on its other side 22 opposite the annular recess 18, with a cylindrical raised part 24.

The application of the drainage valve to bag wall 4 is achieved preferably by heat welding of the wall itself on the spaced radial raised ribs 12.

In this way, the wall 4 remains detached from disc surface 11 for the remaining part and the fat, fluidized by the heat, can flow partially between wall 4 and surface 11 itself in the zones comprised between said raised ribs 12, particularly through grooves 14 communicating with collecting groove 16 and 17, and collecting in annular recess 18 from where it flows out through hole 6 provided in the wall, as shown by the arrows in FIG. 1. At the end of the cooking phase, the bag containing the cooked ham is removed from the mold and the part of the wall surrounding the hole 6 is thermo sealed to the center zone 20 of the disc.

The advantages afforded by the adoption of a bag provided with drainage valve, avoiding any contact with the meat after cooking and any contamination, are evident.

I claim:

1. A packaging bag, in particular for cooked ham, characterized in that said bag (1) is made of thermoweldable material and is provided, in at least one of its walls (4), with a drainage hole (6), and is further provided, inside said bag, with a drainage valve secured to the wall of said bag, said drainage valve (10) comprising a disc of a plastic material, said disc having a center zone, and said disc further being provided with a plurality of radial, spaced ribs projecting from its surface (11) and facing the adjacent internal surface of the wall of said bag, said wall preferably being secured to said ribs by thermowelding, whereby the center zone (20) of said disc is arranged in front of said drainage hole.

2. A packaging bag according to claim 1, characterized in that said disc is provided with an annular recess (18) surrounding said center zone (20).

3. Packaging bag according to claim 1 or 2, characterized in that the disc forming the drain valve (10) is provided with a plurality of radial grooves (14) facing the adjacent internal wall of said bag and intersecting with circumferential grooves (16, 17), said radial grooves leading into said annular recess (18).

4. Packaging bag according to claim 1 or 2, characterized in that the surface of center zone (20) of the disc forming the drain valve is slightly convex.

5. Packaging bag according to claim 1 or 2, characterized in that drain valve (10) is provided, on its back (22), with a cylindrical raised part (24).

* * * * *